US005564211A

United States Patent [19]

Mossberg et al.

[11] Patent Number: 5,564,211

[45] Date of Patent: Oct. 15, 1996

[54] NORMALLY ENABLED FIREARM CONTROL SYSTEM THAT IS DIRECTIONALLY DISABLED

[75] Inventors: Alan I. Mossberg, Tierra Verde, Fla.; Michael E. Theran, Cheshire; Michael G. Engler, Stamford, both of Conn.

[73] Assignee: O. F. Mossberg & Sons, Inc., North Haven, Conn.

[21] Appl. No.: 503,160

[22] Filed: Jul. 17, 1995

[51] Int. Cl.[6] ..... F41A 17/06; F41A 17/08; F41A 17/74

[52] U.S. Cl. ..... 42/70.11; 42/70.08; 42/70.01

[58] Field of Search ..... 42/70.01, 70.04, 42/70.05, 70.06, 70.08, 70.09, 70.11

[56] References Cited

U.S. PATENT DOCUMENTS

| | | | |
|---|---|---|---|
| 3,939,679 | 2/1976 | Barker et al. | 70/277 |
| 4,003,152 | 1/1977 | Barker et al. . | |
| 4,067,132 | 1/1978 | Smith | 42/66 |
| 4,105,885 | 8/1978 | Orenstein | 42/84 |
| 4,135,320 | 1/1979 | Smith | 42/66 |
| 4,154,014 | 5/1979 | Smith | 42/66 |
| 4,354,189 | 10/1982 | Lemelson | 340/543 |
| 4,467,545 | 8/1984 | Shaw, Jr. . | |
| 4,488,370 | 12/1984 | Lemelson . | |
| 4,563,827 | 1/1986 | Heltzel . | |
| 4,682,435 | 7/1987 | Heltzel | 42/70.01 |
| 4,970,819 | 11/1990 | Mayhak | 42/70.01 |
| 5,016,376 | 5/1991 | Pugh | 42/70.11 |
| 5,022,175 | 6/1991 | Oncke et al. | 42/70.11 |
| 5,062,232 | 11/1991 | Eppler | 42/70.11 |
| 5,068,989 | 12/1991 | Martin | 42/70.01 |
| 5,123,193 | 6/1992 | Pugh | 42/70.01 |
| 5,168,114 | 12/1992 | Enget | 42/70.01 |
| 5,448,847 | 9/1995 | Teetzel | 42/70.11 |

FOREIGN PATENT DOCUMENTS

| | | | |
|---|---|---|---|
| 2505604 | 8/1976 | Germany | 42/70.09 |
| 2940513 | 4/1981 | Germany | 42/70.09 |
| 3446019 | 6/1986 | Germany | 42/70.11 |
| 3510169 | 9/1986 | Germany | 42/70.09 |

*Primary Examiner*—Stephen M. Johnson

*Attorney, Agent, or Firm*—Richard H. Kosakowski; Holland & Bonzagni, P.C.

[57] ABSTRACT

A firearm, such as a shotgun, is normally-enabled at all times for firing. An authorized user, such as a police officer, wears a transmitter that transmits signal energy in all directions. The transmitter may be worn by the authorized user on the user's person. The transmitter transmits a "disable" system that is received by a corresponding signal receiver built into the firearm only when the muzzle of the firearm is pointed in the direction of the authorized user. That is, the receiver has a narrow angular spatial range of signal reception. In this way, if the firearm is taken away from the authorized user, or the authorized user accidentally points the firearm at his/her person, then the firearm will be disabled automatically from firing by reception of the "disable" signal sent by the transmitter worn by the authorized user.

19 Claims, 3 Drawing Sheets

NORMALLY ENABLED FIREARM CONTROL SYSTEM THAT IS DIRECTIONALLY DISABLED

BACKGROUND OF THE INVENTION

This invention relates generally to firearm control systems, and more particularly to such a system in which the firearm is normally enabled for firing, but is disabled by the system in response to signals sent by the authorized user from a remote transmitter worn by the user to a receiver located in the firearm.

Persons, such as police officers, security guards and correctional facility officers (i.e., generally "peace officers"), typically carry a firearm, such as a handgun, shotgun or rifle, for their own protection and for the protection of others. These people constantly face the risk of a confrontation or a physical altercation arising with someone such as an assailant in which the officer's firearm is involuntary wrested away from the officer, or the officer is forced, under duress, to hand the officer's firearm over to the assailant. The officer then faces the risk that the officer's own firearm will be used against the officer to wound or kill the officer and/or others.

Apart from the aforedescribed situations in which the officer may be shot by the officer's own gun through the intentional acts of others, situations occur where the officer could inadvertently shoot himself/herself with the officer's own firearm through acts of carelessness.

Therefore, it is desirable to have a control system for a firearm in which the firearm is normally enabled for firing at all times by the officer, except when the firearm is pointed at the officer either with the firearm held by the officer or held by an assailant who has taken possession of the firearm from the officer.

The prior art is replete with firearm control systems of various types. However, all of these systems can be generally placed into two categories: firstly, those which keep the firearm normally disabled and require some means, such as the establishment of a valid communications link, to enable the firearm; and, secondly, those which keep the firearm normally enabled and by some means the firearm is disabled in certain situations.

In general, a primary shortcoming with the normally-disabled type of firearm control system relates to the requirement that the firearm, when carried by peace officers, be capable of immediate usage by the officer; for example, when the officer is threatened by an advancing armed assailant. In such situations, because time is of the essence, it is impractical to require the officer to perform an affirmative act, such as pressing a button on a transmitter, to enable the firearm.

However, there exist firearm control systems in the prior art that enable a normally-disabled firearm merely by requiring the firearm to be within a predetermined distance or range (such as twelve inches) from an active or passive device worn by the officer. In this way, a valid communication link is automatically established without action on the part of the officer. Then, if the officer is threatened with the officer's gun, the gun cannot be fired as long as the gun is beyond the distance required to establish the communication link. Yet this system is not foolproof since often the assailant may hold the officer's gun within the range required to establish the link.

Another concern with this normally-disabled system arises when there is a failure of the means that enables the firearm. If the failure occurs at a critical time when the officer needs the firearm to be enabled to be fired (for example, to stop an advancing armed or knife-wielding assailant), then the officer's firearm is essentially useless. However, fail-safe means may be provided to enable the firearm to be fired upon failure of the firearm control system. Yet, if the firearm is then wrested away from the officer, there is then no means to prevent the officer from being shot by the officer's own gun.

Examples of prior art normally-disabled firearm control systems are given in U.S. Pat. Nos. 4,067,132, 5,168,114, 4,970,819, 5,068,989, 5,123,193, 5,062,232, 5,022,175, 5,016,376, 4,488,370, 4,467,545, 4,154,014, 4,135,320, 4,105,885, 4,003,152 and 3,939,679; all of which are incorporated herein by reference.

On the other hand, with respect to a normally-enabled firearm control system, prior art systems normally require an affirmative act on the part of the officer (such as depressing a button to deactivate a transmitter) to disable the firearm. Again, in situations where time is of the essence, it may be impractical to require the officer to perform such an affirmative act. Also, the officer may have the officer's gun taken away after the assailant has incapacitated or knocked the officer unconscious. Thus, there is no way the officer could perform the affirmative act of disabling the firearm.

Examples of prior art normally-enabled firearm control systems are given in U.S. Pat. Nos. 4,563,827 and 4,682,435; both of which are incorporated herein by reference.

Accordingly, it is a primary object of the present invention to provide a firearm control system that keeps the firearm normally-enabled for firing by an authorized user, and disables the firearm from firing only when the firearm is pointed in the direction of the authorized user either inadvertently by the authorized user or purposely by someone, such as an assailant, who has obtained unauthorized possession of the firearm.

It is a general object of the present invention to provide a firearm control system that automatically disables a firearm when the firearm is in the hands of an unauthorized user.

It is another object of the present invention to provide a firearm control system that operates as a safety mechanism to prevent both accidental and unauthorized firing of a firearm.

It is yet another object of the present invention to provide a firearm control system that allows a firearm to be automatically disabled by the authorized user without any affirmative action on the part of the authorized user.

The above and other objects and advantages of this invention will become more readily apparent when the following description is read in conjunction with the accompanying drawings.

SUMMARY OF THE INVENTION

To overcome the deficiencies of the prior art and to achieve the objects listed above, the Applicants have invented a control system for a firearm, such as a shotgun.

In a preferred embodiment, an authorized user (e.g., a police officer) of the firearm wears an electronic signal transmitter on the person of the user. The transmitter emits light energy in the infrared ("IR") spectrum in all directions; i.e., 360°. The transmitter is a self-powered unit that is packaged such that it may be worn by the authorized user on the user's wrist, finger, hand, or on the user's body, e.g., in the user's hat, jacket, vest, badge, belt, etc. The energy transmitted may be sufficient in strength to span several hundred feet or more.

Mounted in the stock or handle of the firearm, or, alternatively, on the firearm barrel or magazine tube near the muzzle end, is an electronic signal receiver that receives infrared energy. However, the receiver has a relatively narrow angular range of energy reception; e.g., only 30°. The center axis of this angular range is aligned coaxial with the muzzle of the barrel of the firearm. The receiver output signal is coupled to an electromechanical device, such as a solenoid, whose mechanical output is coupled to the hammer, trigger or firing pin of the firearm. In the absence of reception by the receiver of the IR energy from the transmitter, the solenoid normally enables the firearm for firing.

When the authorized user is in possession of the firearm, the transmitter worn by the user is constantly sending out its "disable" signal in the form of IR energy. However, in such instance, the muzzle of the firearm (and, thus, the signal receiver) is usually not aligned with the transmitter. Thus, the receiver, due to its narrow angular reception range, is not receiving the disable signal from the transmitter, and the firearm is enabled for firing without any affirmative action being needed by the authorized user.

However, if the firearm is taken away from the authorized user (for example, by an armed assailant) and the muzzle of the firearm is pointed at the officer, the receiver will receive the IR signal energy from the transmitter and activate the solenoid to automatically disable the firearm from being fired at the authorized user. Therefore, the preferred embodiment of the firearm control system of the present invention requires no affirmative action on the part of the authorized user to prevent the firearm from being utilized against the authorized user.

The present invention also has utility in preventing the firing of the firearm in the event that the authorized user mishandles the firearm and accidentally points the gun at himself/herself and the trigger is activated.

BRIEF DESCRIPTION OF THE DRAWING SECTION

DETAILED DESCRIPTION OF THE PREFERRED EMBODIMENTS

Figure 1:
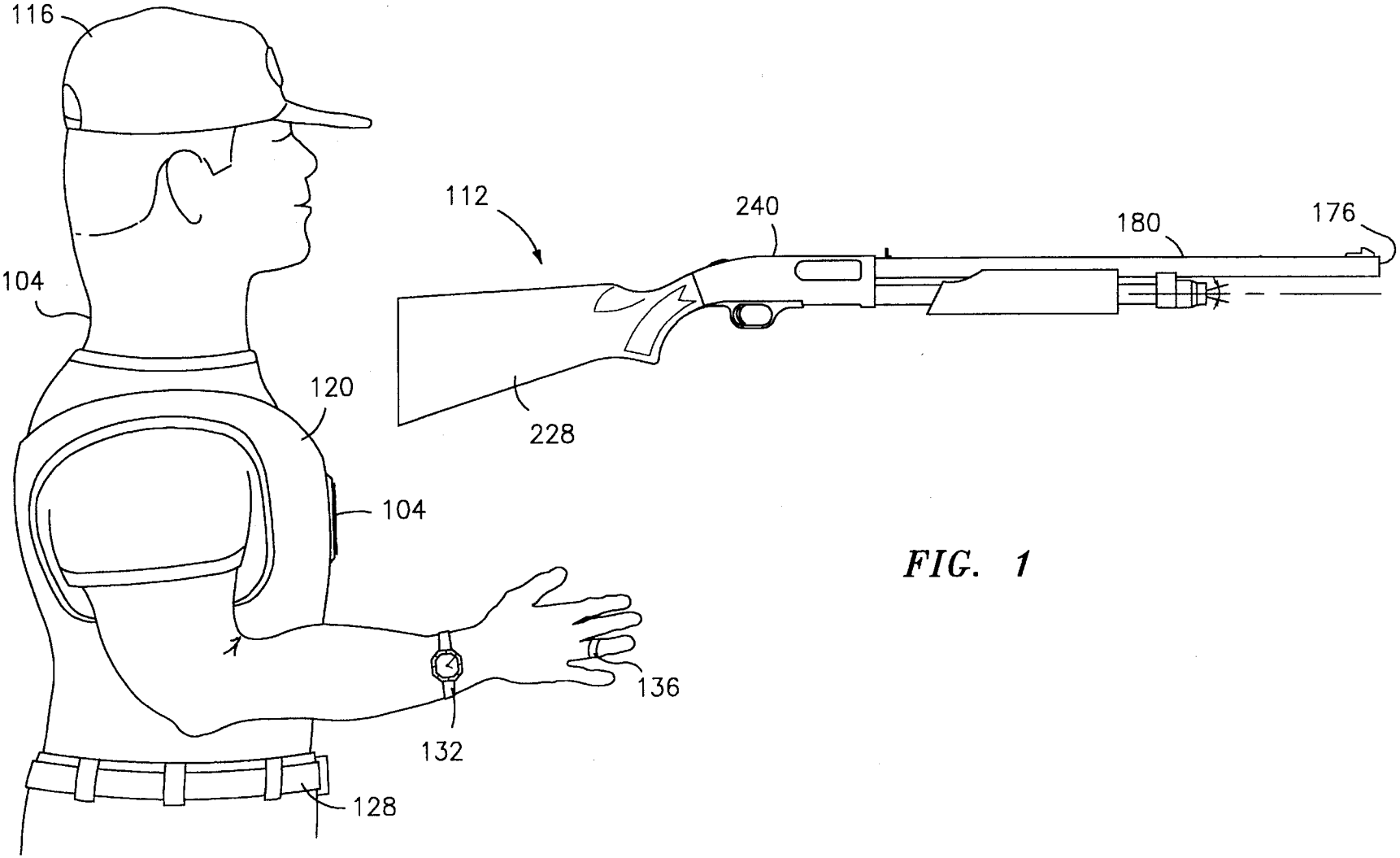
FIG. 1 illustrates a perspective view of an authorized user of a firearm wearing a transmitting device for use with a receiving device located within a shotgun that is normally-enabled for firing.

Referring to the drawings in detail, a preferred embodiment of a firearm control system in accordance with the present invention is illustrated therein. The control system comprises a signal transmitting device 100 worn on the person 104 of an authorized user. The system also comprises a receiving device 108, located within the firearm 112, for receiving the signals transmitted by the transmitting device 100 and for disabling the firearm 112 from being fired upon reception thereof.

Referring to FIG. 1, there illustrated in silhouette form is an authorized user 104 of the firearm control system of the present invention. The user 104 may be a police officer or other type of peace officer. As part of the officer's normal course of duties, the officer may be required to wear certain apparel, such as a hat 116, a vest or jacket 120, a badge 124 and/or a belt 128. These articles of apparel may have attached thereto the transmitter 100 of the control system of the present invention. One or more similar transmitters 100, illustrated in greater detail in FIG. 4, may be simultaneously worn and utilized in accordance with the present invention. Alternatively, the transmitter 100 may be embodied in a wrist band 132 or finger ring 136 worn by the authorized user 104.

Figure 4:
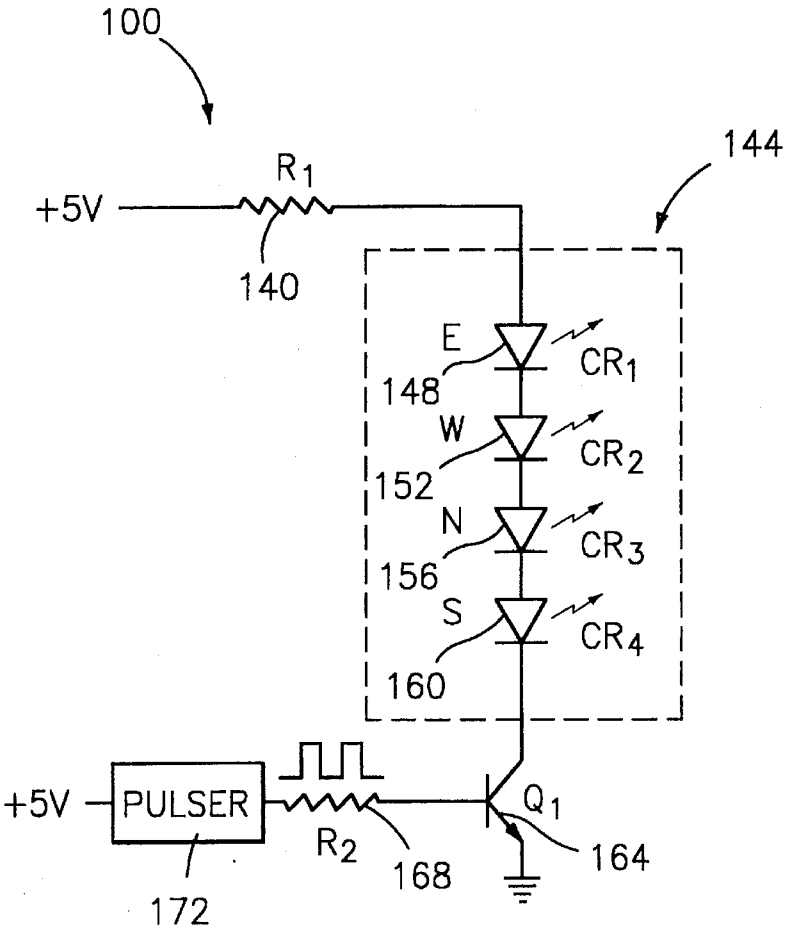
FIG. 4 is a schematic illustration of electronic circuitry that comprises the transmitter worn by the authorized user of FIG. 1.

Regardless of which item of apparel the transmitter 100 is embodied in, the transmitter 100 may comprise, in a preferred embodiment, a self-contained unit that transmits infrared ("IR"), i or other type of radio-frequency ("RF") energy, continuously in all directions and in three dimensions. That is, the transmitter 100 has an angular transmission spatial range of 360°. In a preferred embodiment, as illustrated in FIG. 4, the transmitter 100 transmits IR light energy. However, the invention is not limited as such in its broadest scope. Instead, the transmitter 100 may transmit RF energy at frequencies that are in other than the light spectrum.

Referring to FIG. 4, the transmitter 100 is self-powered by a battery (not shown) that provides, e.g., +5VDC. This voltage is applied to one side of a current limiting resistor, $R_1$ 140. The other side of this resistor 140 is connected to a series connection 144 of four infrared energy emitting diodes, $CR_{1-4}$ 148–160. These diodes 148–160, which may be commercially available from a number of sources, may be such that they each have an effective angular transmission spatial range of 90° or more. In a preferred embodiment, each diode $CR_{1-4}$ 148–160, has an effective angular transmission spatial range of approximately 115°. The diodes 148–160 are arranged such that there is a small amount of overlap in the transmission spatial range of adjacent diodes. In this way, all 360° may be covered (with a small degree of overlap between the diodes) to insure that there are no spatial regions, however small, that do not contain energy transmitted from these diodes 148–160. Such directional transmission alignment is indicated in FIG. 4 for each diode by the corresponding directional symbols "E" (i.e., "East"), "W" (i.e., "West"), "N" (i.e., "North"), and "S" (i.e., "South").

The collector terminal of an NPN transistor, $Q_1$ 164, connects to the bottom end of the series connection 144 of diodes 148–160. The emitter terminal of the transistor 164 connects to ground, while the base terminal of the transistor 164 connects through a resistor, $R_2$ 168, to a pulser circuit 172. Such a circuit 172 may simply comprise an oscillator circuit that provides a repetitive square wave pulse to the base terminal of the transistor, $Q_1$ 164, thereby turning it on and off in a repeating pattern. Each time the transistor, $Q_1$ 164, is turned on, current flows through the series connection 144 of the light emitting diodes 148–160, thereby enabling the diodes to transmit their light energy. Conversely, when the transistor, $Q_1$ 164, is turned off, no current flows through the diodes 148–160 and, thus, no light energy is emitted therefrom.

It should be noted that each of the diodes 148–160 has an effective transmission range of several hundred feet or more, in order for the firearm control system of the present invention to effectively disable the firearm 112 from being fired at the authorized user from such distances.

Instead of utilizing light energy as the transmission medium, the transmitter 100 may instead utilize RF energy outside of the light energy spectrum. In such instance, the transmission diodes 148–160 would be replaced by an RF energy transmitter.

Referring back to FIG. 1, also illustrated therein is a shotgun 112 in which is mounted the energy receiving device 108 according to the present invention. The shotgun 112 may comprise the Model 500, provided by O. F. Mossberg & Sons, Inc., the assignee of the present invention. In the alternative, the firearm 112 may comprise other than a shotgun; for example, a hand gun or a rifle. The firearm enable system of the present invention is equally applicable to all types of firearms, in light of the teachings herein. FIG. 1 illustrates the firearm 112 as it may normally be oriented with respect to the user 104 when the user 104 is firing such firearm 112. Alternatively, although not shown, the firearm 112 may also be disposed at the side of the authorized user such that the muzzle end 176 of the barrel 180 of the firearm 112 is pointed at the ground.

Figure 2:
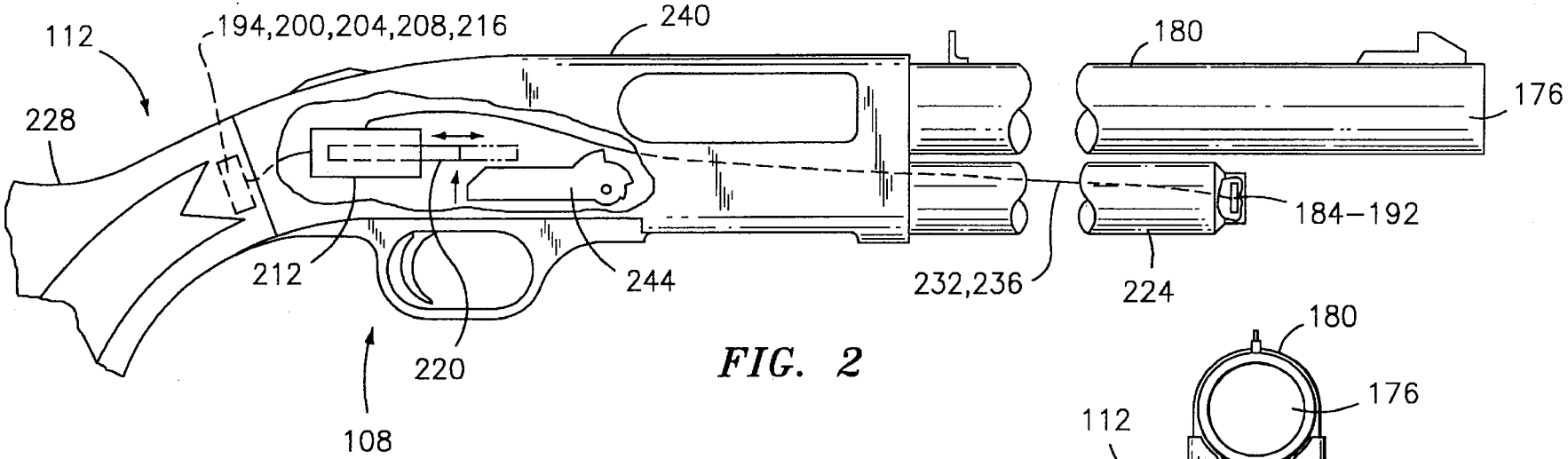
FIG. 2 is a detailed view, partially cut away, that illustrates the shotgun of FIG. 1 having the receiving device therein.
Figure 3:
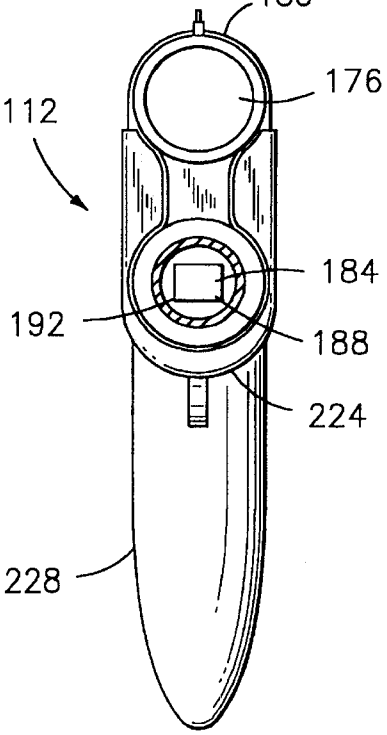
FIG. 3 is an end view of the shotgun of FIGS. 1 and 2.
Figure 5:
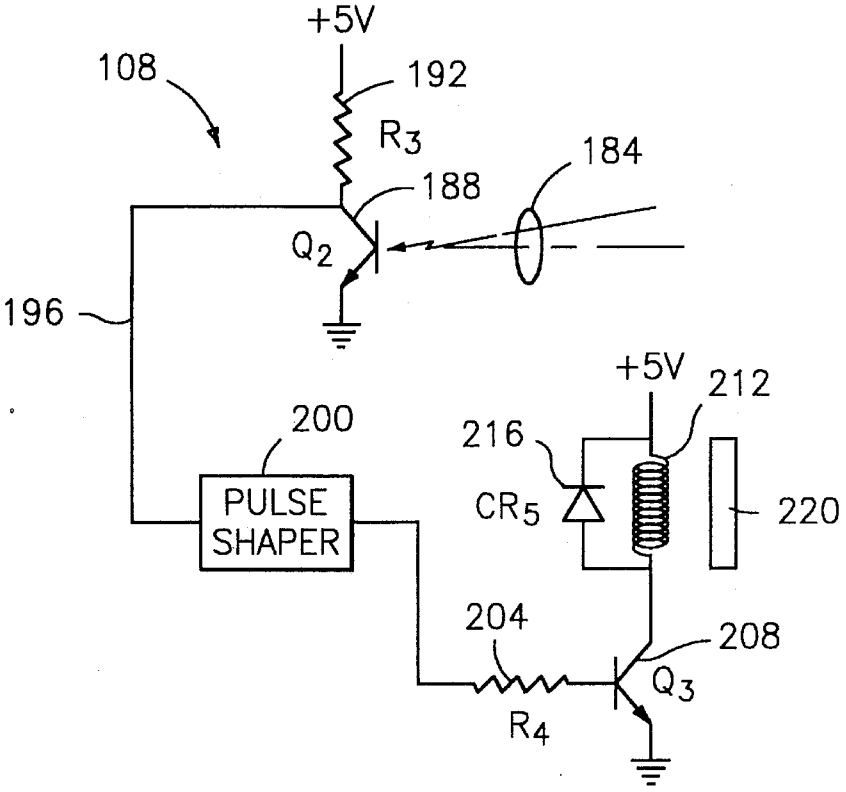
FIG. 5 illustrates a schematic diagram of electronic circuitry, together with associated optics, that comprises the receiver located within the firearm of FIG. 1.

Referring now to FIGS. 2, 3 and 5, there illustrated in more detail is the signal receiver portion 108 of the firearm control system of the present invention. The receiver 108 may comprise an optical lens 184 for focussing the infrared light energy sent from the transmitter 100. The lens 184 may have an effective angular spatial range of less than 90°. In a preferred embodiment of the present invention, the lens 184 has an effective angular spatial range of 30° or less. It is this relatively small angular spatial reception range of the lens 184, relative to the omni-directional (i.e., 360°) transmission angular spatial range of the transmitter 100, that is a key aspect of the present invention.

Referring to FIG. 5, the optical energy focussed by the lens 184 is impinged upon the base terminal of a photo transistor, $Q_2$ 188. The emitter terminal of the transistor 188 is connected to ground, while the collector terminal of the transistor 188 is connected through a pull-up resistor, $R_3$ 192, to +5VDC. This voltage may be supplied by a battery 194. The collector terminal of the transistor, $Q_2$ 188, comprises a voltage output signal that is indicative of the amount of light energy received by the photo transistor 188. This voltage signal on a line 196 is fed to a pulse shaper circuit 200, which may comprise a standard signal conditioning circuit.

The output of the pulse shaper 200 is fed through a resistor, $R_4$ 204, to the base terminal of an NPN transistor, $Q_3$ 208. The emitter terminal of this transistor 208 is connected to ground, while the collector terminal of the transistor 208 connects to one end of a coil 212 of a solenoid. The other end of the solenoid coil connects to +5VDC. A diode, $CR_5$ 216, connects across the solenoid coil 212. When current flows through the solenoid coil 212, a magnetic field is established that moves a solid magnetic core component or rod 220 of the solenoid in a certain direction. Current only flows through the solenoid coil 212 when there is sufficient voltage at the base terminal of transistor $Q_3$ 208 to turn that transistor on. This base current is established by the voltage on the collector terminal of the photo transistor, $Q_2$ 188. It follows that the proper voltage on the collector terminal of the photo transistor, $Q_2$ 188, is only established when the lens 184 has received sufficient light energy transmitted from the light emitting diodes, $CR_{1-4}$ 148–160, located within the transmitter portion 100 of the firearm control system of the present invention.

Referring also to FIGS. 2 and 3, the components heretofore described in FIG. 5 are located within the firearm 112 as illustrated therein. In a preferred embodiment, the lens 184, the photo transistor $Q_2$ 188, and the resistor, $R_3$ 192, are all located in the vicinity of the muzzle end 176 of the barrel 180 of the firearm 112. Specifically, these components may be located at the forward end of the magazine tube 224 just below the barrel 180 of the firearm 112. Referring also to FIG. 1, the lens 184 is oriented in an angular direction such that its angular reception spatial range is directed forward of the muzzle end 176 of the barrel 180 of the firearm 112. In other words, the lens 184 only receives energy that is essentially focussed towards the muzzle end 176 of the barrel 180 of the firearm 112. Further, the center axis of this angular reception spatial range may be aligned co-axial with an axis passing through the muzzle end 176, of the barrel 180 of the firearm 112.

As best illustrated in FIG. 2, the pulse shaper 200, the resistor $R_4$ 204, the transistor $Q_3$ 208, the diode $CR_5$ 216 and the battery 194 that supplies the +5VDC to the components of the receiver 108, may all be located within the stock or handle 228 of the shotgun. Power may be supplied to the resistor $R_3$ 192 at the end of the magazine tube 224 by a wire 232. Another wire 236 may also be utilized as the signal line connecting the collector of the transistor $Q_2$ 188 to the pulse shaper circuit 200.

On the other hand, the solenoid coil 212, together with the solenoid activator or rod 220, may be disposed within the receiver portion 240 of the shotgun 112. The solenoid coil 212 and rod 220 are oriented with respect thereto such that when the solenoid is normally "off" (that is, with no current applied to the solenoid coil 212), the solenoid rod 220 is in a first mechanical position (indicated by the solid lines in FIG. 2) such that movement of the hammer 244 portion of the shotgun 112 is uninhibited thereby. In such instance, the firearm 112 functions in its normal manner (that is, the shotgun is normally-enabled). However, when current flows through the solenoid coil 212, a magnetic field is created that moves the solenoid rod 220 into the position shown in phantom in FIG. 2. This position physically blocks the movement of the hammer 244 of the shotgun 112, thereby prohibiting firing of the shotgun 112 when the solenoid rod 220 is in such position. As described hereinbefore, the solenoid rod 220 only blocks the hammer 244 from firing when the infrared light energy (or "disabled" signal) transmitted from the signal transmitter portion 100 of the control system of the present invention has been received by the lens 184 and converted into an electronic signal that enables current to flow through the solenoid coil 212.

In accordance with the present invention, such a "disabling" condition of the normally-enabled firearm 112 occurs only when the muzzle end 176 of the barrel 180 of the firearm 112 is pointed toward the authorized user 104. Also as described hereinbefore in detail, such conditions would only occur if the firearm 112 were taken away from the authorized user 104, or if the authorized user 104 carelessly pointed the firearm 112 at himself/herself. The limited angular reception spatial range (e.g., ≦30°) prevents the firearm 112 from being disabled in virtually all other conditions.

The signal receiver 108 has been described as comprising a lens 184 located at the forward end of the magazine tube 224 of the shotgun 112. However, this is purely exemplary. The receiver lens 184 may be located, instead, either within the stock or handle 228 of the firearm 112, or on some other portion of the firearm 112 such that the lens 184 is operable to receive the light energy transmitted by the transmitter 100 portion of the control system only when the barrel 180 of the firearm 112 is basically pointed at the transmitter 100, which is worn by the authorized user 104. Further, the solenoid coil 212 and the solenoid rod 220, has been described as being located within the receiver portion 240 of the firearm 112 for interacting with the hammer 244. However, again, this is purely exemplary. Other electromechanical devices besides a solenoid may be utilized for controlling the hammer 244 or other mechanically actuable devices within the trigger of the firearm 112.

Still further, if the transmitter 100 transmits RF energy in other than the light energy spectrum, then the components comprising the receiver of FIG. 5 would be modified somewhat to remove at least the lens 184 and insert, instead, another type of device for directionally receiving the transmitted RF energy within a certain reception angular spatial range of preferably, e.g., 30° or less.

It should be understood by those skilled in the art that obvious structural modifications can be made without departing from the spirit of the invention. Accordingly, reference should be made primarily to the accompanying claims, rather than the foregoing specification, to determine the scope of the invention.

Having thus described the invention, what is claimed is:

1. A device for controlling the firing of a firearm, comprising:

a. transmitter means, located a part from the firearm, for transmitting one or more firearm disable signals; and b. receiving means, located within the firearm, for receiving the one or more firearm disable signals and for disabling the firearm from being fired in response thereto, the receiving means being operable to receive the one or more firearm disable signals over a predetermined angular reception spatial range that is less than 360°, wherein the transmitter means comprises means for transmitting the one or more firearm disable signals over a predetermined angular transmission spatial range of 360°.

2. The device of claim 1, wherein the predetermined angular reception spatial range is less than 90°.

3. The device of claim 1, wherein the predetermined angular reception spatial range is less than 30°.

4. The device of claim 1, wherein the receiving means further comprises signal reception means for receiving the one or more firearm disable signals and for providing corresponding one or more solenoid signals in response thereto, and further comprising electromechanical means for disabling the firearm from being fired when the one or more solenoid signals are indicative of receipt by the receiving means of the one or more firearm disable signals from the transmitter means.

5. The device of claim 4, wherein the electromechanical means further comprises a solenoid having a coil and an actuator, the solenoid coil being electrically connected with the solenoid signals.

6. The device of claim 5, wherein the solenoid actuator is mechanically connected with a firing mechanism of the firearm.

7. The device of claim 6, wherein the solenoid actuator is mechanically connected with a hammer of the firearm.

8. The device of claim 1, wherein the transmitter means is adapted to be worn on a person of an authorized user.

9. The device of claim 8, wherein the transmitter means is adapted to be attached to a hat worn on a head of a person of the authorized user.

10. The device of claim 8, wherein the transmitter means is adapted to be attached to a garment worn on a torso of the person of the authorized user.

11. The device of claim 10, wherein the garment is a vest.

12. The device of claim 10, wherein the garment is a jacket.

13. The device of claim 8, wherein the transmitter means is adapted to be attached to a badge worn on the person of the authorized user.

14. The device of claim 8, wherein the transmitter means is adapted to be attached to a belt worn on the person of the authorized user.

15. The device of claim 1, wherein a center axis of the predetermined angular reception spatial range is aligned coaxial with a muzzle end of a barrel of the firearm.

16. The device of claim 1, wherein an axis passing through a muzzle end of a barrel of the firearm and being coaxial with the barrel is within the predetermined angular reception spatial range.

17. The device of claim 1, wherein the transmitter means comprises means for transmitting the one or more firearm disable signals at a predetermined radio frequency, and wherein the receiving means comprises means for receiving the one or more firearm disable signals at the predetermined radio frequency.

18. The device of claim 1, wherein the transmitter means comprises means for transmitting the one or more firearm disable signals at a predetermined frequency within an infrared light energy spectrum, and wherein the receiving means comprises means for receiving the one or more firearm disable signals at the predetermined frequency within the infrared light energy spectrum.

19. The device of claim 1, wherein the receiving means is mounted on a barrel of the firearm at the muzzle and thereof.

* * * * *